US008904917B2

(12) United States Patent
Rosenboom et al.

(10) Patent No.: US 8,904,917 B2
(45) Date of Patent: Dec. 9, 2014

(54) FLUID POWER HELICAL ROTARY ACTUATOR

(75) Inventors: Darin Michael Rosenboom, Orange City, IA (US); Ryan Lee Bolkema, Hull, IA (US); Daniel Jon Van Regenmorter, Sheldon, IA (US)

(73) Assignee: Rosenboom Machines & Tool, Inc., Sheldon, IA (US)

( * ) Notice: Subject to any disclaimer, the term of this patent is extended or adjusted under 35 U.S.C. 154(b) by 900 days.

(21) Appl. No.: 13/087,733

(22) Filed: Apr. 15, 2011

(65) Prior Publication Data

US 2012/0263616 A1 Oct. 18, 2012

(51) Int. Cl.

| | |
|---|---|
| ***F01B 3/00*** | (2006.01) |
| ***F04B 53/14*** | (2006.01) |
| ***F04B 9/02*** | (2006.01) |
| ***F04B 9/04*** | (2006.01) |

(52) U.S. Cl.

CPC . *F04B 9/02* (2013.01); *F04B 53/14* (2013.01); *F04B 9/047* (2013.01)

USPC ..... 92/33

(58) Field of Classification Search

USPC ..... 92/31, 33

See application file for complete search history.

(56) References Cited

U.S. PATENT DOCUMENTS

| | | | | | |
|---|---|---|---|---|---|
| 3,393,610 | A | * | 7/1968 | Aarvold | 92/33 |
| 3,499,342 | A | * | 3/1970 | Ligh | 92/33 |
| 3,530,769 | A | * | 9/1970 | Gurevich | 92/33 |
| 3,758,941 | A | * | 9/1973 | Jackson et al. | 29/464 |
| 4,015,728 | A | * | 4/1977 | Barker et al. | 92/33 |
| 4,313,367 | A | * | 2/1982 | Weyer | 92/33 |
| 5,241,895 | A | | 9/1993 | Weyer | |
| 5,267,504 | A | | 12/1993 | Weyer | |
| 5,309,816 | A | | 5/1994 | Weyer | |
| 5,327,812 | A | | 7/1994 | Weyer et al. | |
| 5,447,095 | A | * | 9/1995 | Weyer | 92/33 |
| 5,477,772 | A | | 12/1995 | Weyer | |
| 5,609,090 | A | | 3/1997 | Weyer | |
| 5,671,652 | A | | 9/1997 | Weyer | |
| 6,585,079 | B1 | | 7/2003 | Weyer | |

* cited by examiner

*Primary Examiner* — Michael Leslie

(74) *Attorney, Agent, or Firm* — McKee, Voorhees & Sease

(57) ABSTRACT

A fluid-powered, helical rotary actuary is provided. The actuary includes a housing, a shaft with output ends positioned in the housing, and a piston sleeve surrounding the shaft and also positioned within the housing. The shaft includes a groove for receiving a collar. The collar creates a false shoulder such that the shaft is able to have the same diameter along the length of the shaft, thus allowing for a larger working area and more torque output density. The actuary also includes a support ring positioned on the shaft near the splined portion of the output end. The support ring is used to stabilize the attachment of an external member, and also to protect the shaft from damage caused by the splined receiving portion of the external member, or hub.

28 Claims, 8 Drawing Sheets

FLUID POWER HELICAL ROTARY ACTUATOR

FIELD OF THE INVENTION

The present invention relates generally to rotary actuators. More specifically, but not exclusively, the invention relates to an improved fluid power helical rotary actuator having an output shaft for providing rotational motion to an attached component and/or assembly.

BACKGROUND OF THE INVENTION

Rotary actuators produce oscillating power by rotating an output shaft through a fixed arc. They are compact, simple, and efficient. They produce high instantaneous torque in either direction and require only a small space and simple mountings.

The helical-spline actuator has a long, slender configuration and uses a sliding helical splined gear operating concept to convert linear piston motion into shaft rotation. It is composed of a cylindrically shaped housing and two moving parts: the shaft and the annular piston sleeve. Helical spline teeth machined on the shaft engage a matching complement of splines on the inside diameter of the piston. The outside diameter of the piston sleeve carries a second set of helical splines that engages a ring gear integral with the housing.

The piston sleeve is hydraulically sealed between the housing and shaft. When hydraulic pressure is applied to the port to the left of the piston, three events occur simultaneously. The piston sleeve is displaced axially, moving to the right; it rotates clockwise (as viewed from the output shaft) as the gearing on its outside diameter and the housing's ring gear forces its rotation; and the gearing on the inside diameter of the piston sleeve causes the shaft to rotate clockwise. Applying pressure to the alternate port returns the piston sleeve to its original starting position and rotates the shaft counterclockwise.

The double helix, opposite hand design of the gear sets compound the rotation of the shaft, so its rotation is considerably more than that of the piston sleeve. For 30° helix designs, the rotation of the shaft is almost twice that of the piston sleeve, for 45° helix designs, it is even more. Features of this design include high torque from a compact configuration, constant torque through full angle of rotation, no internal leakage, and holding torque approximately two times the forward driving torque.

Since the angle of rotation is determined by actuator length, and because there are no internal barriers as in vane designs, any rotation is theoretically possible. Conversely, an appropriate internal stop tube can limit the rotation of an actuator to almost any intermediate angle. Most helical actuators, however, are available with 90°, 180°, and 360° rotations as standard.

Problems do exist with standard helical rotary actuators. The torque output of helical actuators is a function of the working area of the actuator. The working area is the area between the diameter of the interior wall of the housing that the piston sleeve rides in and the diameter of the shaft that the piston rides on. Currently, the shaft has to be stepped to create a shoulder that a bearing rides against. However, by creating the shoulder, the diameter of the shaft must be greater. The diameter of the output shaft that protrudes out of the actuator is smaller than the diameter of the shaft that the piston rides on. As the housing diameter is kept constant to provide the smallest actuator possible, this reduces the amount of working area that an actuator can have. Therefore, the amount of torque output is limited by the diameter of the housing itself.

Additionally, the shaft output is generally splined to allow for attaching the actuator to a separate external member. For output shafts that are splined, the splines are not all the way up to the edge because the tool that cuts the splines needs clearance. This means that the hub that is inserted on the shaft is not supported the whole way, which creates the ability for it to be less stable and wobble and cause wear.

Therefore, there is a need in the art to provide a fluid powered, helical rotary actuator that is compact in size, but that produces a high torque output. There is also a need in the art for a smaller helical rotary actuator that produces the same torque output as is currently required. Additionally, there is a need in the art to protect the splined output shafts of helical rotary actuators and to help stabilize the output rotation.

It is therefore a primary object, feature, and/or advantage of the present invention to overcome or improve on deficiencies in the art.

It is another object, feature, and/or objective of the present invention to provide an improved helical rotary actuator that increases the working area of the actuator.

It is another object, feature, and/or advantage of the present invention to provide an improved helical rotary actuator that produces a greater torque output without increasing the size of the actuator.

It is another object, feature, and/or advantage of the present invention to provide an improved helical rotary actuator that uses a shaft with the same diameter for the piston sleeve and the output portions.

It is another object, feature, and/or advantage of the present invention to provide an improved helical rotary actuator that provides a greater stabilized connection between the output shaft and a hub.

It is another object, feature, and/or advantage of the present invention to provide an improved helical rotary actuator that provides protection for the output shaft for dealing with increased torque thrusts.

These and/or other objects, features, and advantages of the present invention will be apparent to those skilled in the art. The present invention is not to be limited to or by these objects, features and advantages. No single embodiment need provide each and every object, feature, or advantage.

SUMMARY OF THE INVENTION

According to one aspect of the present invention, a helical rotary actuator is provided. The actuator includes a housing, a shaft, a collar, and a piston sleeve. The housing has opposite first and second ends, a generally cylinder-shaped interior wall, and a longitudinal axis therethrough. The shaft is positioned generally coaxially within the housing having a first output end and an opposite second output end. The shaft further comprises a groove adjacent the first output end and a shaft helical gear teeth positioned adjacent the second output end and at least partially surrounding the shaft. The collar is positioned at and at least partially surrounds the groove of the shaft. The piston sleeve includes a piston and a sleeve and is positioned within the housing. The piston sleeve at least partially surrounds the shaft with the piston being adjacent the collar and the sleeve including inner and outer helical gear teeth.

According to another aspect of the present invention, a helical rotary actuator is provided. The actuator includes a housing, a shaft, and a first support ring. The housing has opposite first and second ends, a generally cylinder-shaped interior wall, and a longitudinal axis therethrough. The shaft is positioned coaxially within the housing. The shaft includes a first output end and an opposite second output end, a first splined portion at the first output end, a second splined portion at the second output end, and a shaft helical gear teeth positioned adjacent the second output end and at least partially surrounding the shaft. The support ring at least partially surrounds the shaft and is positioned adjacent the first splined portion.

According to yet another aspect of the present invention, a helical rotary actuator for providing rotational output to an external member is provided. The actuator includes a housing, a shaft, a collar, a first support ring, and a piston sleeve. The housing has opposite first and second ends, a generally cylinder-shaped interior wall, and a longitudinal axis therethrough. The shaft is positioned coaxially within the housing. The shaft includes a first output end and an opposite second output end, a groove adjacent the first output end, a first splined portion at the first output end, a second splined portion at the second output end, and a shaft helical gear teeth positioned adjacent the second output end and at least partially surrounding the shaft. The collar is positioned at least partially surrounding the groove of the shaft. The support ring at least partially surrounds the shaft and is positioned adjacent the first splined portion. The piston sleeve includes a piston and a sleeve and is positioned within the housing. The piston sleeve at least partially surrounds the shaft with the piston being adjacent the collar and the sleeve including inner and outer helical gear teeth.

DETAILED DESCRIPTION OF THE PREFERRED EMBODIMENTS

Figure 1A:
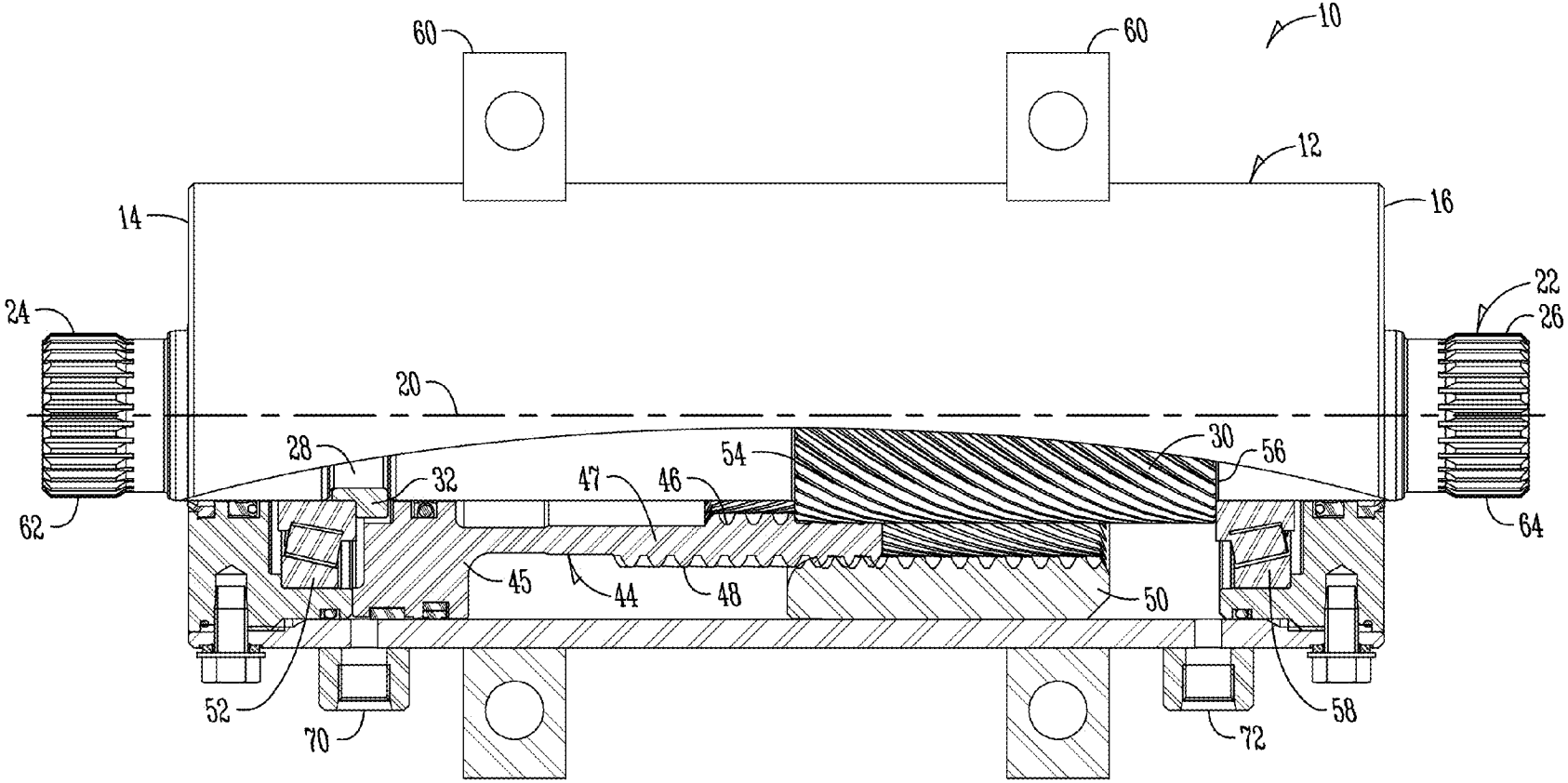
FIGS. 1A-1C are partial sectional views of the helical rotary actuator according to the present invention showing the piston sleeve in three working positions.
Figure 1B:
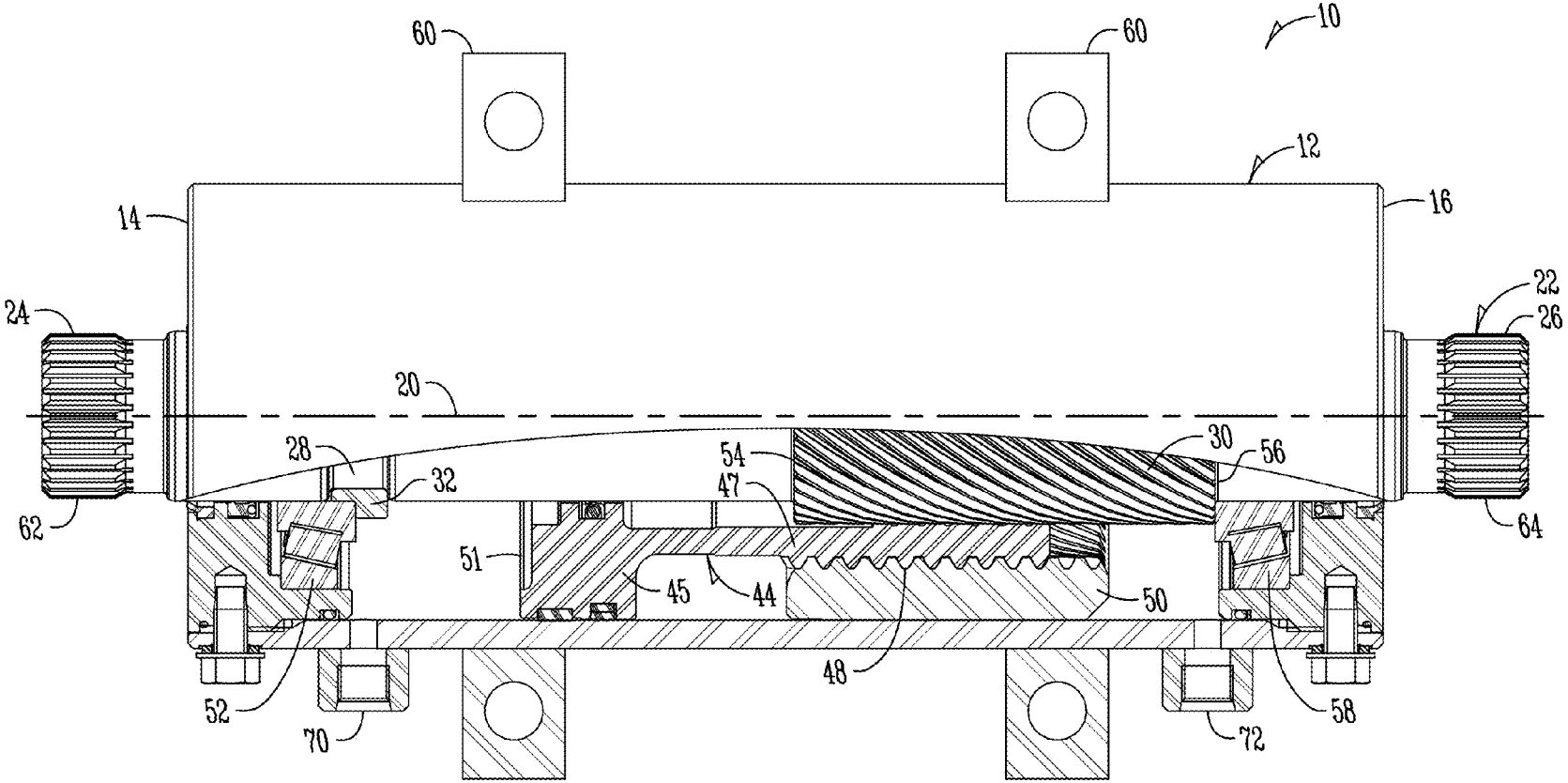
Figure 1C:
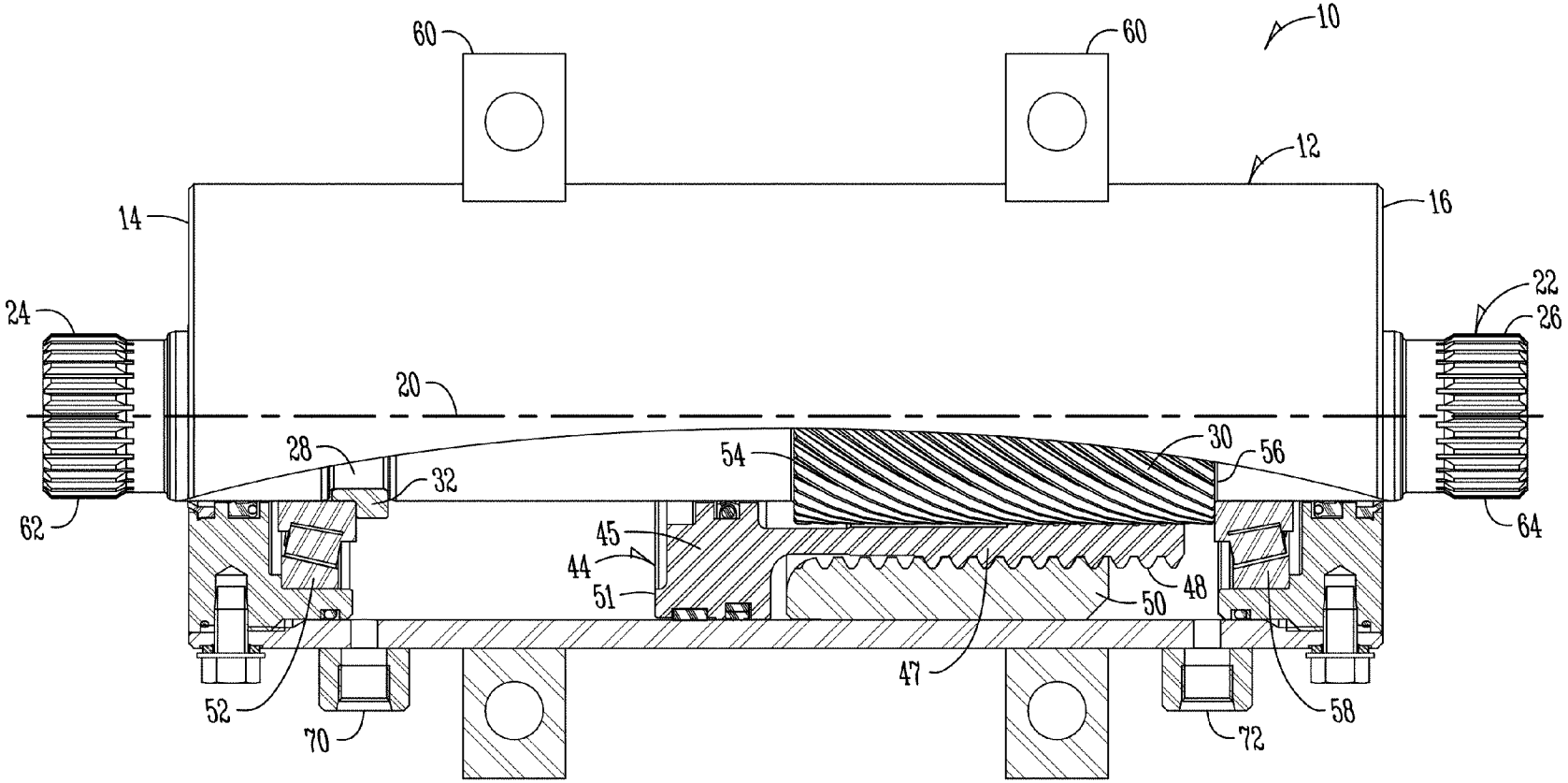

FIGS. 1A-1C show multiple views of the helical rotary actuator according to the present invention. FIGS. 1A-1C are partial sectional views showing an actuator 10 that is fluid powered with a piston sleeve 44 in three working positions. The location of the piston sleeve 44 relates to a generally rotational output for the actuator 10.

The fluid powered helical rotary actuator 10 of the present invention includes a housing 12. The housing is generally cylindrically shaped and includes a longitudinal axis 20 there through. The housing 12 further comprises a first end 14 and a second end 16. An interior wall 18, which is also cylindrically shaped, is part of the housing as well. Located within the housing and generally coaxial with the longitudinal axis 20 is a shaft 22. The shaft is rotatable within the housing 12 and includes a first output end 24 and a second output end 26 extending from opposite sides of the housing 12. However, it should be noted that only one output end may be used as well with the present invention. The first and second output ends 24, 26 are attachable to an external member (not shown) for use in rotating the external member about a preconfigured range of rotation. For instance, the actuator 10 may be configured to rotate the external member between a range of 90°, 180°, 270°, 360°, or somewhere in between. It should be noted that while the specific ranges of motion have been given for the embodiment shown in the present application, the actuator 10 may be many different sizes and have different ranges of rotational output.

As seen in the cutaway portion of the actuator 10 in FIGS. 1A-1C, the shaft 22 further includes a groove 28 near the first output end 24 and a shaft helical gear 30 with helical gear teeth near the second output end 26. However, it should be noted that the shaft may be oriented in the opposite direction such that the groove 28 is adjacent the second output end 26 and the helical gear 30 is adjacent the first output end 24 of the shaft 22. Positioned around the groove 28 of the shaft 22 is a collar 32. The collar 32, as will be discussed in greater detail below, may be one or two separate pieces and is comprised of a generally rigid material, such as steel or the like. It should also be noted that the collar 32 has a piston side 34 and an opposite bearing side 36, as well as a cylinder 38 extending from one side of the collar 32.

Figure 5A:
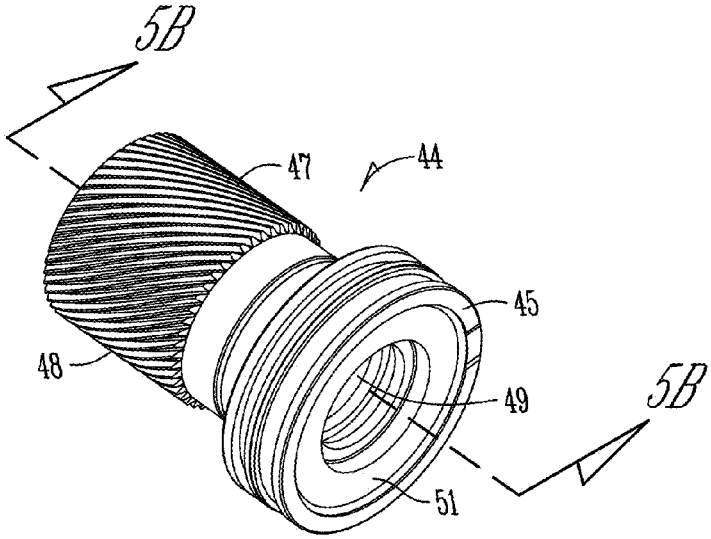
FIGS. 5A and 5B are perspective and sectional views of an embodiment of the piston sleeve used in conjunction with the helical rotary actuator of the present invention.
Figure 5B:
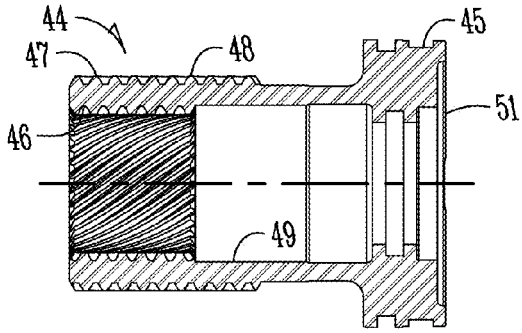

Also positioned at least partially surrounding the shaft 22 is a piston sleeve 44. The piston sleeve, as shown in FIGS. 5A and 5B, is a rigid object generally made of steel or other rigid material. The piston sleeve includes a piston 45 connected to a sleeve portion 47 to form one complete body. The piston sleeve 44 also includes an aperture 49 through which the shaft 22 passes. The piston portion 45 of the piston sleeve 44 is generally circular shaped and includes a working area 51, which is the surface area on the front face of the piston 45. The sleeve portion 47 includes an outer diameter of outer gear teeth 48 and an inner diameter comprising inner gear teeth 46. The inner gear teeth 46 of the piston sleeve 44 are configured to engage and mesh with the teeth of the shaft gear 30. The outer gear teeth 48 are configured to engage and interact with teeth of a ring gear 50, which is positioned around the interior wall 18 of the housing 12.

Also shown in FIGS. 1A-1C are a first splined portion 62 and a second splined portion 64 located at the first and second output ends 24, 26 of the shaft 22. Additionally, a first annular bearing member 52 and a second annular bearing member 58 are shown to be positioned at least partially surrounding the shaft member 22 as well. A plurality of mounting members 60 may be affixed to the housing 12 to mount the actuator 10 to an external member as well. Finally, a first and second fluid port 70, 72 may be included to allow access to inside the housing 12.

The operation of the fluid powered helical rotary actuator 10 will now be discussed in relation to FIGS. 1A-1C. As shown in FIG. 1A, the piston sleeve 44 originally may be found with the piston portion 45 adjacent the collar 32 as well as the first fluid port 70. For purposes of the present invention, this will be known as the "home position." At this "home position" the sleeve portion will be adjacent a first end 54 of the shaft helical gear 30. A fluid, such as hydraulic fluid, may be introduced into and through the first fluid port 70. The fluid presses and creates pressure against the working area 51 of the piston portion 45 of the piston sleeve 44. The pressure on the working area 51 causes the piston sleeve 44 to move in a left to right direction as shown in FIG. 1A. As the sleeve portion 47 is comprised of inner gear teeth 46 and outer gear teeth 48 meshed with helical gear teeth of the shaft gear 30, as well as the helical gear teeth of the ring gear 50, the piston sleeve 44 will rotate while moving in the left to right direction. As the piston sleeve 44 moving in a helical motion meshes with the stationary ring gear 50 and rotates, the meshing with the shaft gear 30 causes compound rotation of the shaft 22. Therefore, the further the piston sleeve 44 is pushed in the left to right direction, the more output rotation the shaft 22 will experience.

Figure 2:
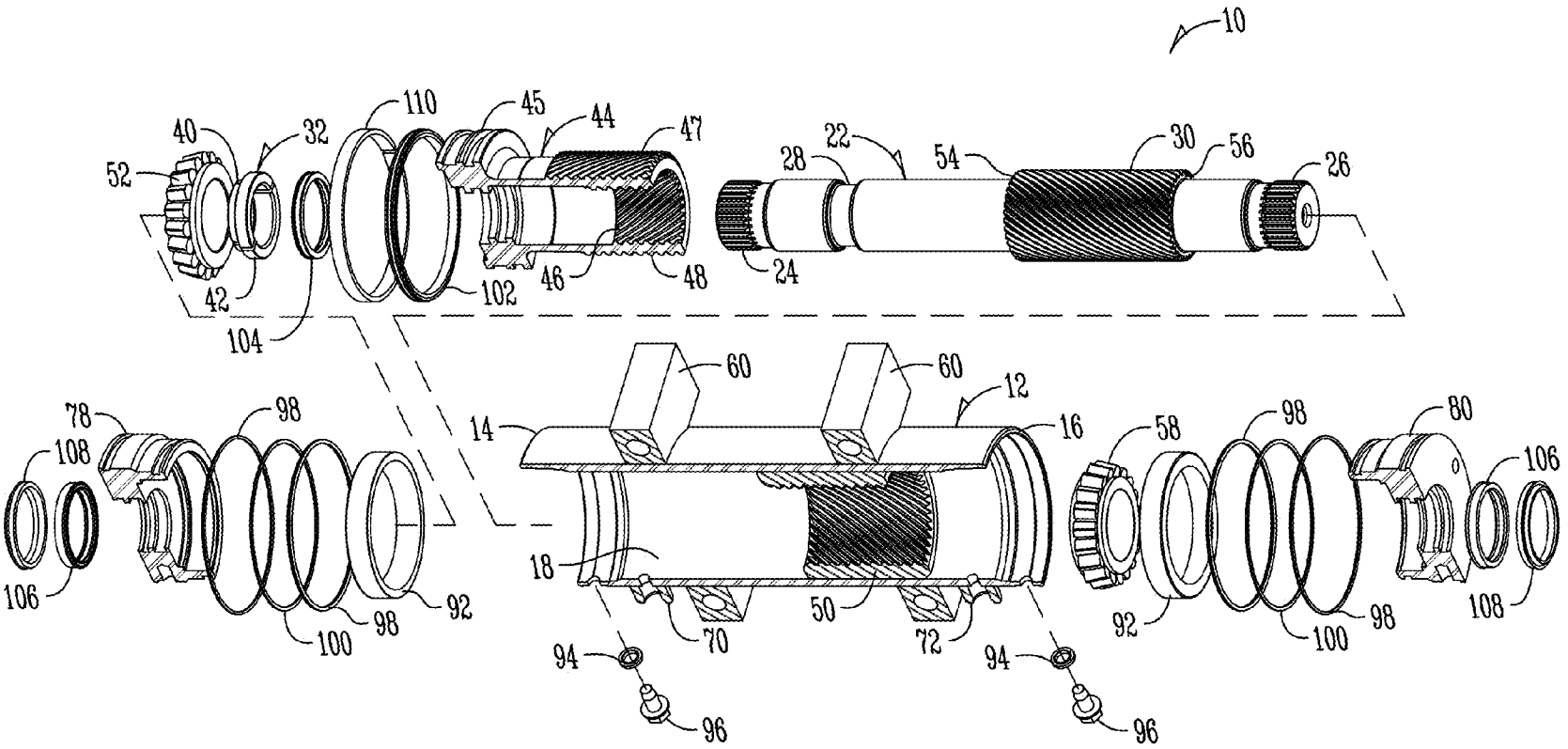
FIG. 2 is an exploded view of the helical rotary actuator of FIG. 1 according to the present invention.

FIG. 1B shows the piston sleeve 44 at a middle point in its range of movement within the housing 12. FIG. 1B shows the working area 51 of the piston sleeve 44, as well as the space in the housing 12 upon which the fluid exists in FIG. 1B. It should be noted that the rotation of the shaft 22 is further allowed by the first and second annular bearing members 52, 58, which are located within first and second head glands 78, 80, as is shown in FIG. 2. As may be shown best in FIG. 1B, the working area 51 is the amount of surface area of the piston 45 between the outer edge of the shaft 22 and the interior wall 18 of the housing 12. Therefore, when the shaft 22 has a smaller diameter, the working area 51 may be larger, which allows for a greater torque density output. The greater torque density output is caused by the greater area that the fluid can act upon the face or working area 51 of the piston 45.

FIG. 1C shows the continued movement in the left to right direction of the piston sleeve 44 within the housing 12. In the position shown in FIG. 1C, the piston sleeve 44 has moved its full range of movement in a left to right direction. This will be called the "end position" for the present invention. Therefore, at this position there can be no greater rotational output to the output shaft 22. However, as the piston sleeve 44 is moveable in both directions, a reciprocal rotation may be achieved by now introducing a fluid, such as hydraulic fluid, through second fluid port 72, while ejecting the existing fluid from the first fluid port 70. This would cause the piston sleeve 44 to move in a generally right to left direction, while also in a helical motion, towards the home position. The helical motion of the piston sleeve 44 would cause the shaft 22 to rotate in a generally opposite direction as has previously been discussed. The fluid may be introduced in second fluid port 72 to move the piston sleeve 44 from the position shown in FIG. 1C to the original or home position shown in FIG. 1A. The process may then be repeated as needed to provide output rotation to the output shaft 22.

FIG. 2 is an exploded view of the helical rotary actuator 10 of FIG. 1 according to the present invention. FIG. 2 shows in greater detail the number of components that may be included with the present invention to provide for the greatest output torque. As discussed above, the housing 12 is a generally cylindrically shaped tube made of a rigid material such as steel. Furthermore, the housing has a first end 14, a second end 16 and an interior wall 18. The shaft 22, as will be discussed in relation to FIG. 3 below, may be machined from a generally cylindrically shaped bar or rod of metal or rigid material. The shaft may also have a plating, such as hard chrome plating, to increase the strength and wearability of the shaft 22. The shaft as shown in FIG. 2 includes a first output end 24 and an opposite second output end 26. At the first and second output ends, 24, 26, it may be desired to have a first splined portion 62 and a second splined portion 64. The splined portions 62, 64 allow the output ends of the shaft to be attached to hubs or other external members (not shown) as desired for the specific use of the actuator 10. The shaft further includes a groove 28 located near the first output end 24 and a shaft gear teeth 30 positioned generally near the second output end 26. The length of the shaft gear teeth 30 depends on the specific use of the actuator 10 and may be lengthened or shortened depending on the range of rotation required for the specific use. Furthermore, the shaft gear 30 includes a first end 54 and a second end 56.

Figure 6A:
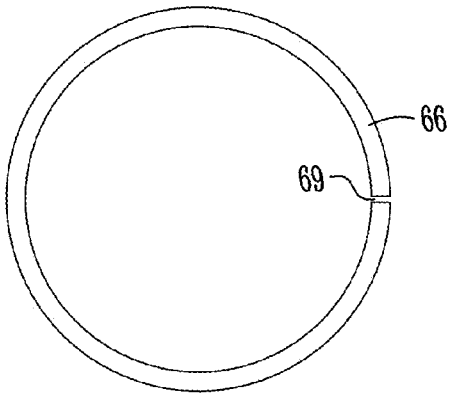
FIGS. 6A and 6B are front and side views of a support ring used in conjunction with the helical rotary actuator of the present invention.
Figure 6B:
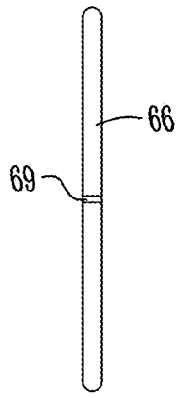

As discussed above, a piston sleeve 44, including a piston portion 45 and a sleeve portion 47, generally surrounds the shaft 22. The sleeve 47 of the piston sleeve 44 also includes an inner gear teeth 46 and outer gear teeth 48. As shown FIG. 2, a bidirectional piston seal 102 and a precision wear guide 110 generally surround the piston portion of the piston sleeve to keep the fluid from passing the edge of the working area 51 of the piston 45. Also, within the piston portion 45 of the piston sleeve 44 is a bidirectional rod seal 104. As the piston sleeve 44 includes a piston sleeve aperture 49 through which the shaft extends, a sealing must also be required inside the aperture 49 itself. As stated above, adjacent the piston sleeve 44 is a collar 32, which is positioned at the groove 28 of the shaft 22. FIG. 2 shows the collar 32 is two pieces, however, it should be noted that the collar 32 may also be one continuous piece. When the collar 32 is comprised of a unitary piece, the groove 28 will be smaller and the collar will have the appearance similar to the support ring 66, as shown in FIGS. 6A and 6B. Therefore, the unitary collar 32 may comprise a hardened spring steel that is fit into the groove 28. A hub or outer ring having a recess (similar to the hub 82 of FIGS. 7A and 7B) is then slid over the end of the shaft 22 and over the collar 32 such that the ring is fit in the recess of the outer ring to create the alternate shoulder. However, in the embodiment shown in FIG. 2, the collar 32 includes a first member 40 and a second member 42. The two pieces 40, 42 of the collar 32 allow the collar to be placed around the groove 28 of the shaft after the shaft is positioned through the piston sleeve 44 inside the housing 12.

On the bearing side 36 of the collar 32 is first annular bearing member 52. As shown in FIG. 2, when the two parts 40, 42 of the collar come together, a generally cylinder shape member 38 extends from the collar and is inserted within the bearing member 52. The piston side 34 of the collar 32 is configured to be adjacent the piston 45 of the piston sleeve 44. The collar 32 creates a false or removable shoulder for the bearing member 52 to press against during thrust loads of the actuator 10. The separate collar 32 allows for the diameter of the shaft 22 to remain the same along the length of the shaft 22. Having the same diameter allows the working area 51 to be larger and therefore more torque to be created in the actuator 10. Also included adjacent the first side 14 of the housing 12 is a first head gland 78. The head gland 78 creates an end to the actuator 10 and also creates housing for O-rings 98, backup ring 100, roller bearing cup 92, unidirectional rod seal 106, and rod wiper 108. The combination of all of the parts on the head gland 78 creates a fluid tight seal for the end of the housing 12. It further should be noted that the head gland 78 may be held in place at the first end 14 of the housing 12 by threading the head gland 78 into the end 14 of the housing 12. A sealed washer 94 and bolt 96 will keep the gland 78 from unthreading. However, it should be appreciated that the head gland 78 may be held in place by other means as well. It is only required that the head gland 78 be held in place such that it is fluid tight, however.

Adjacent the second end 16 of the housing 12 is many of the same components as on the opposite side 14. For instance, a second bearing member 58 and roller bearing cup 92 may be positioned around the shaft 22 near the second output end 26 of the shaft 22 to reduce friction during the rotation of said shaft. The bearing member 58 and bearing cup 92 may be held within a second head gland 80, which is threaded into the second end 16 of the housing 12. The second head gland 80 also includes housings or grooves for O-rings 98, a backup ring 100, a unidirectional rod seal 106, and a rod wiper 108. The second head gland 80 and corresponding seal members or O-rings produce a fluid tight seal for the second end 16 of the housing 12. As mentioned on the first side 14, the second head gland 80 constrained from unthreading by a sealed washer 94 and corresponding bolt 96. However, it should also be appreciated that other means of holding the head gland 80 in place may be used. It should be noted, however, that the first and second head glands 78, 80, are generally formed of machine steel and include grooves, notches, and apertures to hold the corresponding O-rings and seals.

As discussed above, the housing 12 may also include a plurality of housing mounting member 60 as well as first and second fluid ports 70, 72. The mounting members 60 allow the actuator 10 to be mounted to an external member for which it will be used with. The fluid ports 70, 72 may be used to introduce fluid into the housing 12 to move the piston sleeve 44 within the housing to create the rotational output of the shaft member 22.

Figure 3:
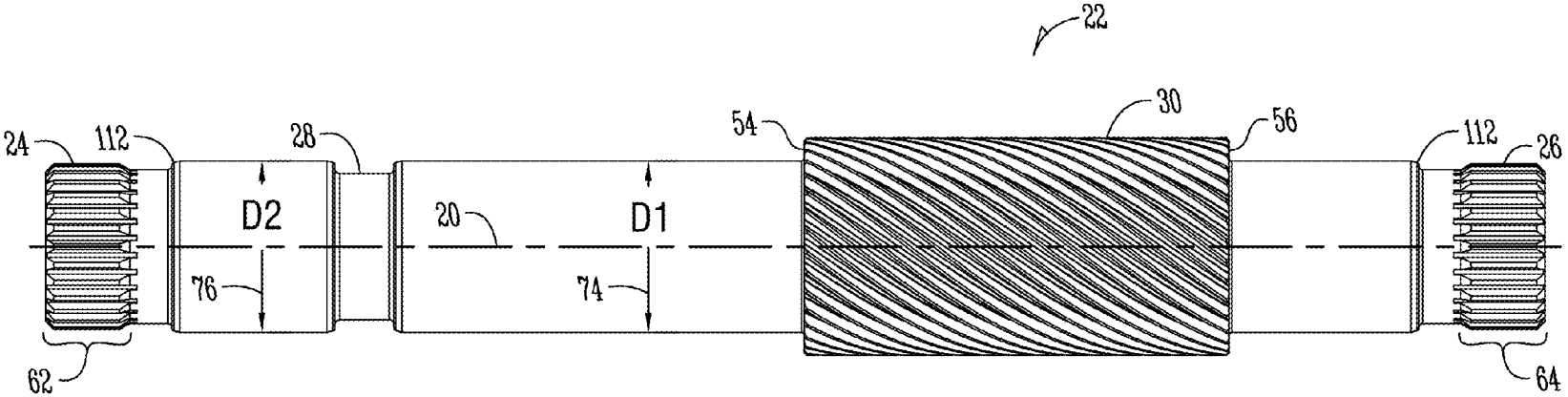
FIG. 3 is a view of the shaft used with the helical rotary actuator according to the present invention.

FIG. 3 is a view of the shaft 22 used with the helical rotary actuator 10 according to the present invention. As discussed above, the shaft 22 is generally machined from a rod of steel or other rigid material capable of withstanding the high speed rotation and rotational forces of the actuator 10. The shaft gear teeth 30 are machined a predetermined length having a first end 54 and a second end 56, with the length of the gear 30 corresponding to the amount of rotation desired from the actuator 10. The portion of the shaft adjacent the first and second ends of the teeth 54, 56 may have a diameter shown as D1 and given numeral 74 in FIG. 3. At a predetermined length from the first end 54 of the gear 30 may be formed or machined a groove 28. The groove is configured to receive the collar 32 to create a removable shoulder member, as discussed above. Between the groove and the first output end 24 of the shaft is a length of shaft having a diameter D2, shown generally as numeral 76. It should be appreciated that the present invention allows for the diameter 74 and the diameter 76 to be equal. Therefore, D1 is equal to D2. A shaft 22 having the same diameter in these two locations is advantageous over the prior art such that the working area 51 of the piston sleeve 44 is greater, which gives the actuator 10 a greater torque density. Having a greater torque density allows a user to obtain more torque from the same size of actuator presently used, or the same torque from the smaller actuator. This is especially important in the field of rotary actuators, as they are used because of space constraints. As discussed above, the shaft 22 includes a first splined portion 62 of the first output end 24 in the second splined portion 64 at the second output end 26. It should also be noted that there is a shoulder 112 at the splined portions. The shoulder 112 is created because the tool that cuts the splines needs clearance. The inclusion of this shoulder 112 with the shaft 22 will be discussed in greater detail below, when discussing the support rings 66, 68.

Figure 4A:
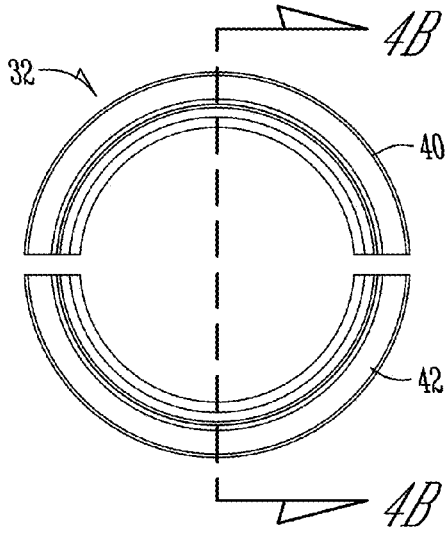
FIGS. 4A and 4B are front and sectional views of the collar used in conjunction with the shaft of FIG. 3 according to the present invention.
Figure 4B:
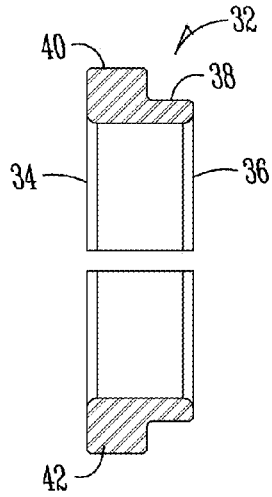

FIGS. 4A and 4B are front and sectional views of the collar 32 used in conjunction with the shaft 22 of FIG. 3 of the present invention. The collar 32 is comprised of a rigid material such as steel or other metal, and may be machined or molded. As shown in FIGS. 4A and 4B, the collar may be comprised of two separate pieces 40 and 42. The first member 40 and second member 42 allow the collar 32 to be placed around the groove 28 of the shaft 22 after the shaft has been positioned within the housing 12 and piston sleeve 44 of the actuator 10. The first and second members 40, 42 are placed adjacent to one another in the groove 28 and are held together by the bearing member 58. However, the first member 40 and second member 42 of the collar may be attached to one another by adhesive, welding, or other means. As shown in FIG. 4B, the collar 32 further includes a piston side 34 and a bearing side 36. Extending from the bearing side is a cylinder portion 38. The cylinder 38 is designed to at least partially insert into the bearing member 52 such that the bearing member rests against the bearing side 36 of the collar 32. This creates a removable or false shoulder that the bearing member may load against.

However, as noted above, the collar 32 may also comprise a unitary piece to fit around the groove 28 of the shaft 22. A unitary collar 32 may take the form similar to the support ring 66 shown in FIGS. 6A and 6B. For instance, the unitary collar 32 would comprise a hardened steel ring made of spring steel or the like. The spring steel would keep the collar 32 snug at the groove 28 to keep the collar 32 in place. A hub or outer ring having a recess (similar to the hub 82 of FIGS. 7A and 7B) is then slid over the end of the shaft 22 and over the collar 32 such that the ring is fit in the recess of the outer ring to create the alternate shoulder.

FIGS. 5A and 5B are perspective and sectional views of an embodiment of the piston sleeve 44 used in conjunction with the helical rotary actuator 10 of the present invention. As discussed above, the piston sleeve 44 includes a piston portion 45 and a sleeve portion 47. The piston and sleeve portions 45, 47 are machined from a unitary or single piece or steel. It should also be appreciated that the piston sleeve 44 may be casted or molded as one unitary piece, with the helical gear teeth either being casted or later machined as required. As discussed above, the piston 45 includes grooves and recesses for receiving seals and O-rings to prevent the fluid from passing from the working area 51 side of the piston to the sleeve 47. These may be machined along with the aperture 49, which is for receiving a shaft 32. Additionally, the sleeve 47 of the piston sleeve 44 includes an inner helical gear 46 having helical gear teeth and an outer helical gear 48 having helical gear teeth. The inner helical gear teeth 46 are configured to mesh and engage with the shaft gear teeth 30. The outer helical gear teeth 48 are configured to mesh and engage with the gear teeth of the stationary ring gear 50. The use of multiple gears allows for the rotation of the piston sleeve 44 to be compounded, which creates a higher amount of rotation in the shaft outputs than actually occurs within the housing 12.

Another aspect of the present invention involves the attachment to the first and second output ends 24, 26 of the shaft 22. FIGS. 6A and 6B are front and side views of a support ring 66 used in conjunction with the helical rotary actuator 10 of the present invention. The support ring 66 is a hardened metal ring comprising spring steel having a wire or circular shape and bent into a circular manner. However, as shown in FIGS. 6A and 6B, it is not a solid ring, but includes a gap 69. The gap 69 allows the ring to fit around an end of the shaft 22, but also to be compressed.

Figure 7A:
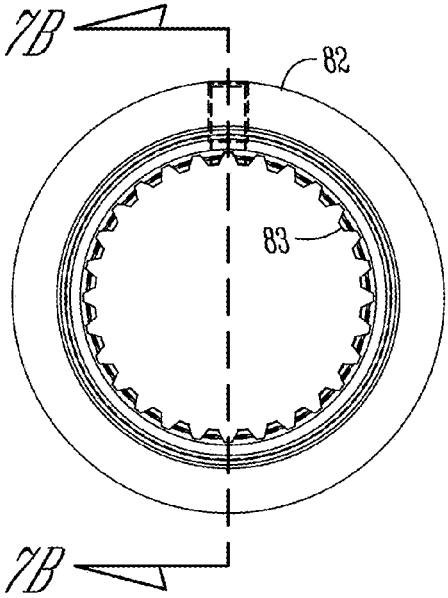
FIGS. 7A and 7B are front and sectional views of a hub used in conjunction with the helical rotary actuator of the present invention.
Figure 7B:
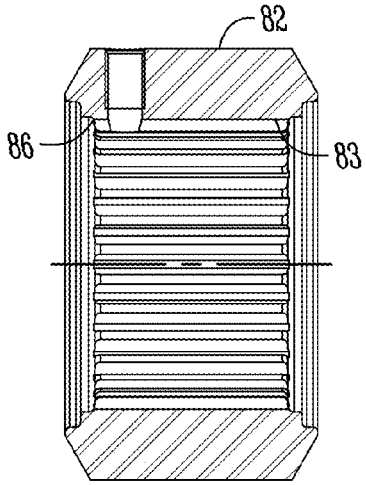

FIGS. 7A and 7B are front and sectional views of a hub 82 used in conjunction with the support ring 66 of the helical rotary actuator 10 of the present invention. The hub 82 is shown as a generally circular piece of metal including a splined teeth or splined portion 83 around the interior of the hub 82. The hub 82 also includes an aperture therethrough. However, it should be noted that the term hub for purposes of the present invention is meant to include any and all members that can be connected to the actuator 10. For instance, while "hub" and "torque arm" are separately used in parts of the present invention, it should be appreciated that the terms are interchangeable, and that one may be present with or without the other. The splined portion 83 of the hub 82 is configured to mesh and engage with the first and second spline portions 62, 64 of the shaft 22. Therefore, a first hub may be used to attach to a first output end 24 of the shaft 22 and a second hub 84 may be used to attach to a second output end 26 of the shaft 22. The hub also includes a recess 86. The hub recess 86 is configured to receive the support ring 66. Therefore, a first support ring 66 will be used at the shoulder 112 of the first output end 24 of the shaft 22, and a second support ring 68 will be used at the shoulder 112 at the second output end 26 of the shaft 22.

Figure 8B:
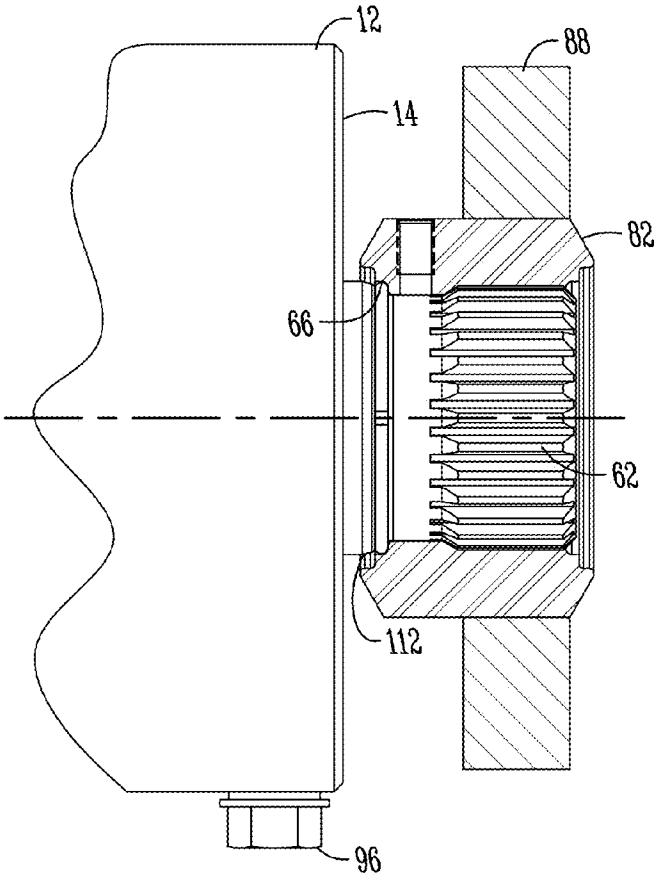
FIGS. 8A and 8B are partially enlarged views of an end of the helical rotary actuator of the present invention with and without a hub attached to the support ring and splined portion of the actuator.
Figure 8A:
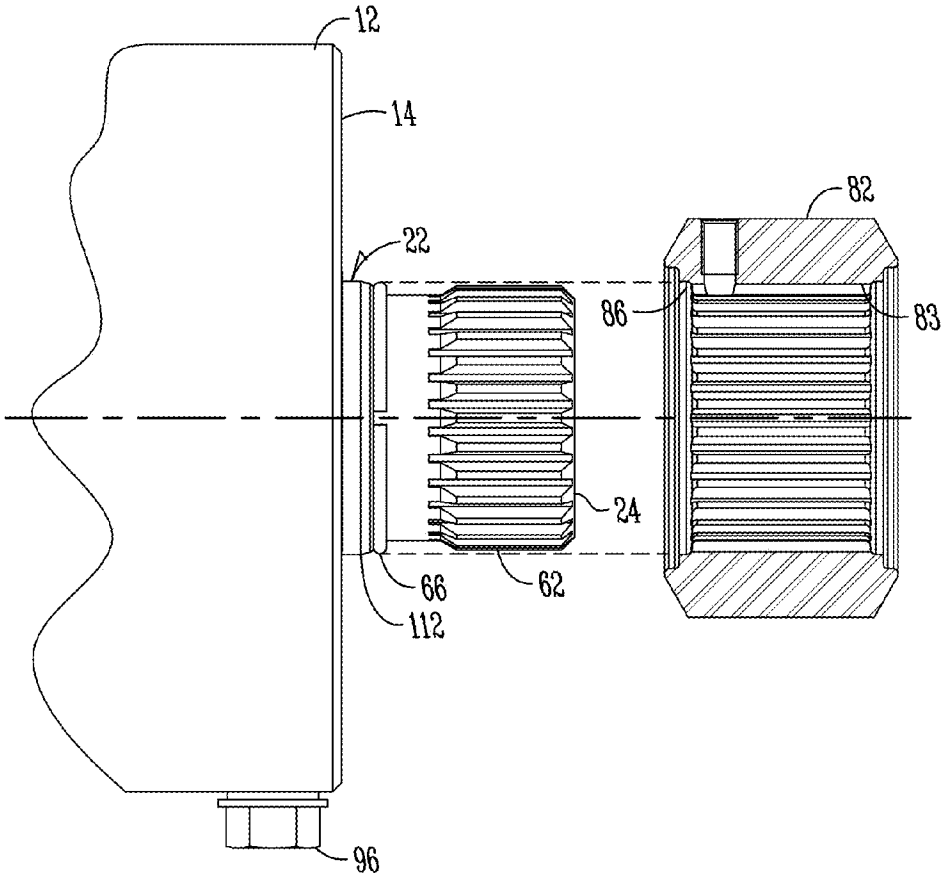

FIGS. 8A and 8B are partially enlarged views of one end of the helical rotary actuator 10 of the present invention with and without a hub 82 attached to the support ring 66 and spline portion 62 of the actuator 10. FIG. 8A shows a support ring 66 positioned around the shaft 22 at the first output end 24 of the shaft and adjacent the shoulder 112 of the shaft. As shown from the broken line in FIG. 8A, the diameter of the support ring 66 is nearly equal to the diameter of recess 86. Therefore, when the spline portion 83 of the hub 82 meshes with the spline portion 62 of the shaft 22 and the support ring 66 is housed within the recess 86 of the hub 82, the hub will be supported and a connection will be more stable. The connection is shown in FIG. 8B. However, it should be noted that the original diameter of the support ring 66 may be slightly larger than the diameter of the hub recess 86 such that the support ring 66 will compress at the gap 69 to forcibly fit within the recess. The force fit of the support ring 66 within the hub recess 86 will ensure that the ring does not slide or move. As FIG. 8B shows, the support ring 66 housed within the recess 86 of the hub 82 and reduces the chance that the hub 82 may wobble when positioned on the spline portion 62 of the shaft 22. In addition, the hardened support ring 66 protects the shaft 22 from the spline teeth 83 of the hub 82 from biting into the shoulder 112 during thrust loads of the actuator 10. Also included in FIG. 8B is the inclusion of a torque arm 88. The torque arm 88 (or arms 88, 90) are used to further connect the actuator 10 to an external member (not shown). The torque arms 88, 90 give the actuator 10 clearance from the external member such that the member will not interfere with the actuator 10 during rotation. Therefore, when the hub is connected to a first or second torque arm 88, 90, as the shaft 22 rotates, the rotation will cause the torque arms 88, 90 to rotate the same range of rotation of the shaft, the operation for which was described above.

Other alternative variations obvious to those in the field of the art are considered to be included in this invention. For example, the size, shape, and material used for the shaft, housing, hub, collar, and piston sleeve may be varied. It should also be noted that the actuator 10 only include one output end of the shaft that extends beyond an end of the housing in circumstances where less stability or torque is required. In addition, the length of the gear teeth in the actuator 10 may be varied to accommodate a variety of output rotational ranges. The description is merely an example of an embodiment and the limitations of the invention are not limited to the application.

What is claimed is:

1. A helical rotary actuator, comprising:

a housing having opposite first and second ends, a generally cylinder-shaped interior wall, and a longitudinal axis therethrough;

a shaft positioned generally coaxially within the housing having a first output end and an opposite second output end, the shaft further comprising a groove adjacent the first output end and a shaft helical gear teeth positioned adjacent the second output end and at least partially surrounding the shaft;

a collar positioned at and at least partially surrounding the groove of the shaft, said collar adapted to support a bearing member positioned at least partially between the groove and the first output end; and a piston sleeve having a piston and a sleeve positioned within the housing, the piston sleeve at least partially surrounding the shaft with the piston being adjacent the collar and the sleeve including inner and outer helical gear teeth.

2. The actuator of claim 1 further comprising a ring gear positioned at and at least partially surrounding the interior wall of the housing, the ring gear adapted to engage the outer helical gear teeth of the piston sleeve.

3. The actuator of claim 1 wherein the inner helical gear teeth of the piston sleeve are adapted to engage the shaft helical gear teeth.

4. The actuator of claim 1 wherein the collar further comprises a piston side and an opposite bearing side.

5. The actuator of claim 4 wherein the collar further comprises a cylinder extending from the bearing side.

6. The actuator of claim 5 wherein the bearing member comprises a first annular bearing member surrounding an area near the first output end of the shaft and adjacent the bearing side of the collar.

7. The actuator of claim 6 wherein the shaft helical gear teeth include a first end and an opposite second end.

8. The actuator of claim 7 further comprising a second annular bearing member surrounding an area near the second output end of the shaft and adjacent the second end of the shaft helical gear teeth.

9. The actuator of claim 1 wherein the housing further comprises at least one mounting member adapted to mount the actuator to an external member.

10. The actuator of claim 1 wherein the first output end of the shaft includes a splined portion and the second output end of the shaft includes a splined portion.

11. The actuator of claim 10 wherein the splined portions of the first and second output ends of the shaft are adapted to operably connect to an external device.

12. The actuator of claim 11 further comprising a first support ring at least partially surrounding the shaft at an area adjacent the first splined portion, and a second support ring at least partially surrounding the shaft at an area adjacent the second splined portion.

13. The actuator of claim 1 wherein the housing further comprises first and second fluid ports.

14. The actuator of claim 1 wherein a diameter of the shaft at an area between an end of the shaft helical gear teeth and the groove is the same as a diameter of the shaft at an area between the groove and the first output end of the shaft.

15. The actuator of claim 1 wherein the collar is a split collar including first and second members that are placed adjacent to one another to surround the shaft at the groove.

16. The actuator of claim 8 further comprising a first head gland positioned near the first shaft output end and at least partially surrounding the first annular bearing member and shaft, and a second head gland positioned near the second shaft output end and at least partially surrounding the second annular bearing member and shaft.

17. A helical rotary actuator, comprising:

a housing having opposite first and second ends, said housing having a generally cylinder-shaped interior wall and having a longitudinal axis therethrough;

a shaft positioned generally coaxially within the housing having a first output end and an opposite second output end, the shaft further comprising a first splined portion at the first output end, a second splined portion at the second output end, and a shaft helical gear teeth positioned adjacent the second output end and at least partially surrounding the shaft;

a first support ring at least partially surrounding the shaft and positioned adjacent the first splined portion;

a second support ring at least partially surrounding the shaft and positioned adjacent the second splined portion; and first and second hubs operably connected to the first and second splined portions of the shaft, the hub further comprising a recess adapted to engage the first and second support rings.

18. The actuator of claim 17 wherein the shaft further comprises a groove adjacent the first output end.

19. The actuator of claim 18 further comprising a collar positioned at and at least partially surrounding the groove of the shaft.

20. The actuator of claim further comprising a piston sleeve having a piston and a sleeve positioned within the housing, the piston sleeve at least partially surrounding the shaft with the piston being adjacent the collar and the sleeve including inner and outer helical gear teeth.

21. The actuator of claim 17 wherein the first and second hubs are housed within first and second torque arms, the first and second torque arms adapted to operably connect to an external device.

22. The actuator of claim 17 wherein the housing further comprises at least one mounting member to mount the actuator to an external member.

23. A helical rotary actuary for providing rotational output to an external member, comprising:

a housing having opposite first and second ends, said housing having a generally cylinder-shaped interior wall and having a longitudinal axis therethrough;

a shaft positioned generally coaxially within the housing having a first output end and an opposite second output end, the shaft further comprising a groove adjacent the first output end, a first splined portion at the first output end, a second splined portion at the second output end, and a shaft helical gear teeth positioned adjacent the second output end and at least partially surrounding the shaft;

wherein a diameter of the shaft at an area between an end of the shaft helical gear teeth and the groove is the same as a diameter of the shaft at an area between the groove and the first output end of the shaft;

a collar positioned at and at least partially surrounding the groove of the shaft;

a first support ring at least partially surrounding the shaft and positioned adjacent the first splined portion; and a piston sleeve having a piston and a sleeve positioned within the housing, the piston sleeve at least partially surrounding the shaft with the piston being adjacent the collar and the sleeve including inner and outer helical gear teeth.

24. The actuator of claim 23 further comprising a first hub operably connected to the first splined portion of the shaft and adapted to receive the first support ring.

25. The actuator of claim 23 further comprising a second support ring at least partially surrounding the shaft and positioned adjacent the second splined portion.

26. The actuator of claim 25 further comprising a second hub operably connected to the second splined portion of the shaft and adapted to receive the second support ring.

27. The actuator of claim 23 wherein the collar comprises at least two pieces, the at least two pieces of the collar being adjacent and opposing to each other around the groove of the shaft.

28. The actuator of claim 23 wherein the housing further comprises a ring gear positioned at and at least partially surrounding the interior wall of the housing, and first and second fluid ports adapted to receive and release a fluid.

* * * * *

UNITED STATES PATENT AND TRADEMARK OFFICE

CERTIFICATE OF CORRECTION

PATENT NO. : 8,904,917 B2
APPLICATION NO. : 13/087733
DATED : December 9, 2014
INVENTOR(S) : Rosenboom et al.

It is certified that error appears in the above-identified patent and that said Letters Patent is hereby corrected as shown below:

In the Claims

Col. 11, Claim 20, Line 22:
ADD AFTER CLAIM -- 19 --

Signed and Sealed this
Twenty-fourth Day of March, 2015

Michelle K. Lee

Michelle K. Lee
*Director of the United States Patent and Trademark Office*